US008870604B2

(12) United States Patent
Chang

(10) Patent No.: US 8,870,604 B2
(45) Date of Patent: Oct. 28, 2014

(54) AUDIO JACK AND SOUND EFFECT OUTPUT DEVICE HAVING THE SAME

(71) Applicant: Nai-Chien Chang, New Taipei (TW)

(72) Inventor: Nai-Chien Chang, New Taipei (TW)

( * ) Notice: Subject to any disclaimer, the term of this patent is extended or adjusted under 35 U.S.C. 154(b) by 50 days.

(21) Appl. No.: 13/830,584

(22) Filed: Mar. 14, 2013

(65) Prior Publication Data

US 2014/0187100 A1 Jul. 3, 2014

(30) Foreign Application Priority Data

Dec. 28, 2012 (TW) ..... 101225561 U
Jan. 29, 2013 (TW) ..... 102201916 U

(51) Int. Cl.
*H01R 24/00* (2011.01)
*H01R 24/58* (2011.01)

(52) U.S. Cl.
CPC ..... *H01R 24/58* (2013.01)
USPC ..... 439/669

(58) Field of Classification Search
USPC ..... 439/669, 668, 188, 858, 660, 607.43, 439/502, 638; 200/51.1, 51.12, 51.03, 200/51.04
See application file for complete search history.

(56) References Cited

U.S. PATENT DOCUMENTS

| | | | | |
|---|---|---|---|---|
| 6,056,602 | A * | 5/2000 | Wu | 439/668 |
| 6,688,918 | B2 * | 2/2004 | Wang et al. | 439/668 |
| 6,761,593 | B2 * | 7/2004 | Hu | 439/668 |
| 7,407,416 | B1 * | 8/2008 | Rogers et al. | 439/669 |
| 7,670,192 | B2 * | 3/2010 | Wu | 439/669 |
| 7,699,665 | B1 * | 4/2010 | Yin | 439/669 |
| 7,789,712 | B1 * | 9/2010 | Peng et al. | 439/668 |
| 7,854,633 | B2 * | 12/2010 | Lynch et al. | 439/669 |
| 8,597,061 | B2 * | 12/2013 | Liang et al. | 439/669 |
| 8,662,937 | B2 * | 3/2014 | Tian et al. | 439/668 |
| 8,696,391 | B2 * | 4/2014 | Ladouceur et al. | 439/668 |

* cited by examiner

*Primary Examiner* — Jean F Duverne
(74) *Attorney, Agent, or Firm* — Muncy, Geissler, Olds & Lowe, P.C.

(57) ABSTRACT

A sound effect output device has an audio jack for an inserting plug of an earphone. The audio jack has a ground connecting pin, a first audio channel connecting pin, a second audio channel connecting pin, a start connecting pin, a detective connecting pin and a microphone connecting pin. Each of the connecting pins is disposed to a base body of the audio jack and surroundingly disposed to an inserting hole of the base body. After the inserting plug is inserted, the inserting plug collides an elastic sheet on a plate body of the first audio channel connecting pin, and the elastic sheet collides an insulating portion of the start connecting pin, the insulating portion drives the acting portion to act for contacting and conducting with a first conducting portion or a second conducting portion of the detective connecting pin.

20 Claims, 13 Drawing Sheets

AUDIO JACK AND SOUND EFFECT OUTPUT DEVICE HAVING THE SAME

BACKGROUND OF THE INVENTION

1. Field of the Invention

The present invention relates to a sound effect inserting base, in particular, to a sound effect output device capable of detecting insertion of an inserting plug of an earphone.

2. Description of Related Art

As known, all kinds of electronic devices have an audio jack provided for an user to insert an inserting plug of an earphone into an inserting hole of the audio jack, such that music played by the electronic device can be listened.

A traditional audio jack, as illustrated in FIG. 1, has a base body 10*a*. The base body 10*a* has an inserting hole 11*a*. At least one start connecting pin 20*a* and a detective connecting pin 30*a* are surroundingly disposed to the inserting hole 11*a* of the base body 10*a*. The start connecting pin 20*a* has a propping sheet 21*a* made of plastic materials. When a probing needle 41*a* of an inserting plug 40*a* of an earphone is inserted into the inserting hole 11*a* of the base body 10*a* and the probing needle 41*a* is inserted onto the bottom, a head portion 42*a* of a front end of the probing needle 41*a* collides an arc surface 22*a* of the propping sheet 21*a*, and the propping sheet 21*a* is collided to drive the start connecting pin 20*a* to contact and conduct with a sheet 31*a* of the detective connecting pin 30*a*, such that the start connecting pin 20*a* and the detective connecting pin 30*a* form a signal conduction loop. Accordingly, an external circuit board (not shown) detects insertion of the probing needle 41*a* of the inserting plug 40*a*, and the circuit board immediately outputs voice signal to each of the connecting pin of the audio jack.

Since the inserting plug 40*a* of the earphone is inserted and plucked frequently and the head portion 42*a* of the probing needle 41*a* has a sharp line 43*a*, the sharp line 43*a* may scratch the arc surface 22*a* of the propping sheet 21*a* under frequent insertion and plucking, such that the propping sheet 21*a* wears. Further, the head portion 42*a* of the probing needle 41*a* has an external diameter with a step mismatch of ø2.5-ø3.0 mm, such that the start connecting pin 20*a* and the detective connecting pin 30*a* cannot contact and conduct with each other, and that the lifetime of the audio jack is decreased.

SUMMARY OF THE INVENTION

The primary objective of the present invention is to solve the problem of timing errors resulted from a worn propping sheet according to the related art. In the present invention, since an acting portion is integrally formed on a start connecting pin for decreased wear resulted from insertion and plucking, the problem of a head portion of an inserting plug having an external diameter with a step mismatch of ø2.5-ø3.0 mm is solved, such that the start connecting pin and a detective connecting pin can stably contact with each other. At the same time, production of an audio jack can be much easier, and its cost can be lowered.

In order to achieve the above-mentioned objective, the present invention provides an audio jack for an inserting plug of an earphone, comprising:

a base body having an inserting hole;

a first audio channel connecting pin disposed inside the base body and surroundingly disposed to the inserting hole, the first audio channel connecting pin having a plate body, an elastic sheet extending from the plate body, the elastic sheet having a bending portion;

a start connecting pin disposed inside the base body and corresponding to the first audio channel connecting pin, the start connecting pin having a flat plate body corresponding to the first audio channel connecting pin, the flat plate body having an acting portion, the acting portion having an insulating portion;

a detective connecting pin disposed inside the base body and corresponding to the start connecting pin, the detective connecting pin having a main body, the main body having a first conducting portion and a second conducting portion corresponding to each other and extending from a side of the main body;

wherein, after the inserting plug of the earphone is inserted for colliding the bending portion of the elastic sheet, the elastic sheet collides the insulating portion, such that the acting portion is driven for contacting and conducting with the first conducting portion or the second conducting portion, so as to send a detection signal.

Preferably, the first audio channel connecting pin is a left audio channel connecting pin or a right audio channel connecting pin, the elastic sheet of the first audio channel connecting pin is of L-shape or V-shape, the plate body of the first audio channel connecting pin has a contacting portion, and the contacting portion is electrically connected to an external circuit board.

Preferably, an end of the start connecting pin has an electrical connecting point, and the electrical connecting point is electrically connected to the external circuit board.

Preferably, the main body of the detective connecting pin is of flat-plate shape, the main body has a contacting end, the contacting end is electrically connected to the external circuit board, and the first conducting portion and the second conducting portion of the detective connecting pin are of curved-arc shape.

Preferably, the audio jack further includes a ground connecting pin disposed inside the base body and surroundingly disposed to the inserting hole, and the ground connecting pin has a front connecting point and a back connecting point electrically connected to the external circuit board.

Preferably, the audio jack further includes a second audio channel connecting pin being a left audio channel connecting pin or a right audio channel connecting pin, the second audio channel connecting pin disposed inside the base body and surroundingly disposed to the inserting hole, the second audio channel connecting pin has a sheet portion, a contacting elastic sheet of L-shape, C-shape or V-shape extends from an end of the sheet portion, the sheet portion has a contacting point, and the contacting point is electrically connected to the external circuit board.

Preferably, the audio jack further includes a microphone connecting pin disposed to the inside of the base body and surroundingly disposed to the inserting hole, an end of the microphone connecting pin has a first contacting portion of L-shape, C-shape or V-shape, another end of the microphone connecting pin has a second contacting portion, and the second contacting portion is electrically connected to the external circuit board.

In order to achieve the above-mentioned objective, the present invention further provides an audio jack for an inserting plug of an earphone, comprising:

a base body having an inserting hole;

a first audio channel connecting pin disposed inside the base body and surroundingly disposed to the inserting hole, the first audio channel connecting pin having a flat plate portion, an extending sheet extending from the flat plate portion, the extending sheet having a crooking portion, an electrode portion bending from a side of the flat plate portion;

a first start connecting pin disposed inside the base body and surroundingly disposed to the inserting hole, the first start connecting pin having a frame body, an elastic sheet extending from the frame body, the elastic sheet having a bending portion;

a second start connecting pin disposed to the inside of the base body and corresponding to the first start connecting pin with each other, the second start connecting pin having a flat plate body corresponding to the first start connecting pin with each other, the flat plate body having an acting portion, the acting portion having an insulating portion;

a detective connecting pin disposed inside the base body and corresponding to the start connecting pins, the detective connecting pin having a main body, the main body having a first conducting portion and a second conducting portion corresponding to each other extending from a side of the main body;

wherein, after the inserting plug of the earphone is inserted for simultaneously colliding the crooking portion of the first audio channel connecting pin and the bending portion of the first start connecting pin, an end of the elastic sheet collides the insulating portion of the second start connecting pin, such that the acting portion is driven for contacting and conducting with the first conducting portion or the second conducting portion, so as to send a detection signal.

Preferably, the first audio channel connecting pin is a left audio channel connecting pin or a right audio channel connecting pin, and the electrode portion is electrically connected to an external circuit board.

Preferably, an end of the second start connecting pin has an electrical connecting point, and the electrical connecting point is electrically connected to the external circuit board.

Preferably, the main body of the detective connecting pin is of flat-plate shape, the main body has a contacting end, the contacting end is electrically connected to the external circuit board, and the first conducting portion and the second conducting portion of the detective connecting pin are of curved-arc shape.

Preferably, the audio jack further includes a ground connecting pin disposed inside the base body and surroundingly disposed to the inserting hole, and the ground connecting pin has a front connecting point and a back connecting point electrically connected to the external circuit board.

Preferably, the audio jack further includes a second audio channel connecting pin being a left audio channel connecting pin or a right audio channel connecting pin, disposed to the inside of the base body and surroundingly disposed to the inserting hole, the second audio channel connecting pin has a sheet portion, a contacting elastic sheet of L-shape, C-shape or V-shape extends from an end of the sheet portion, the sheet portion has a contacting point, and the contacting point is electrically connected to the external circuit board.

Preferably, the audio jack further includes a microphone connecting pin disposed inside the base body and surroundingly disposed to the inserting hole, an end of the microphone connecting pin has a first contacting portion of L-shape, C-shape or V-shape, another end of the microphone connecting pin has a second contacting portion, and the second contacting portion is electrically connected to the external circuit board.

In order to achieve the above-mentioned objective, the present invention further provides a sound effect output device, including:

an audio jack for an inserting plug of an earphone, comprising:

a first audio channel connecting pin disposed inside the base body and surroundingly disposed to the inserting hole, the first audio channel connecting pin having a flat plate portion, an extending sheet extending from the flat plate portion, the extending sheet having a crooking portion, an electrode portion bending from a side of the flat plate portion;

a first start connecting pin disposed inside the base body and surroundingly disposed to the inserting hole, the first start connecting pin having a frame body, an elastic sheet extending from the frame body, the elastic sheet having a bending portion;

a second start connecting pin disposed inside the base body and corresponding to the first start connecting pin, the second start connecting pin having a flat plate body corresponding to the first start connecting pin with each other, the flat plate body having an acting portion, the acting portion having an insulating portion;

a detective connecting pin disposed inside the base body and corresponding to the start connecting pins, the detective connecting pin having a main body, a first conducting portion and a second conducting portion corresponding to each other extending from a side of the main body;

wherein, after the inserting plug of the earphone is inserted for simultaneously colliding the crooking portion of the first audio channel connecting pin and the bending portion of the first start connecting pin, an end of the elastic sheet collides the insulating portion of the second start connecting pin, such that the acting portion is driven for contacting and conducting with the first conducting portion or the second conducting portion, so as to send a detection signal.

Preferably, the first audio channel connecting pin is a left audio channel connecting pin or a right audio channel connecting pin, and the electrode portion is electrically connected to an external circuit board.

Preferably, an end of the second start connecting pin has an electrical connecting point, and the electrical connecting point is electrically connected to the external circuit board.

Preferably, the main body of the detective connecting pin is of flat-plate shape, the main body has a contacting end, the contacting end is electrically connected to the external circuit board, and the first conducting portion and the second conducting portion of the detective connecting pin are of curved-arc shape.

Preferably, the sound effect output device further includes a ground connecting pin disposed inside the base body and surroundingly disposed to the inserting hole, and the ground connecting pin has a front connecting point and a back connecting point electrically connected to the external circuit board.

Preferably, the sound effect output device further includes a second audio channel connecting pin being a left audio channel connecting pin or a right audio channel connecting pin, disposed to the inside of the base body and surroundingly disposed to the inserting hole, the second audio channel connecting pin has a sheet portion, a contacting elastic sheet of L-shape, C-shape or V-shape extends from an end of the sheet portion, the sheet portion has a contacting point, and the contacting point is electrically connected to the external circuit board.

Preferably, the sound effect output device further includes a microphone connecting pin disposed inside the base body and surroundingly disposed to the inserting hole, an end of the microphone connecting pin has a first contacting portion of L-shape, C-shape or V-shape, another end of the microphone connecting pin has a second contacting portion, and the second contacting portion is electrically connected to the external circuit board.

DETAILED DESCRIPTION OF THE INVENTION

Figure 1:
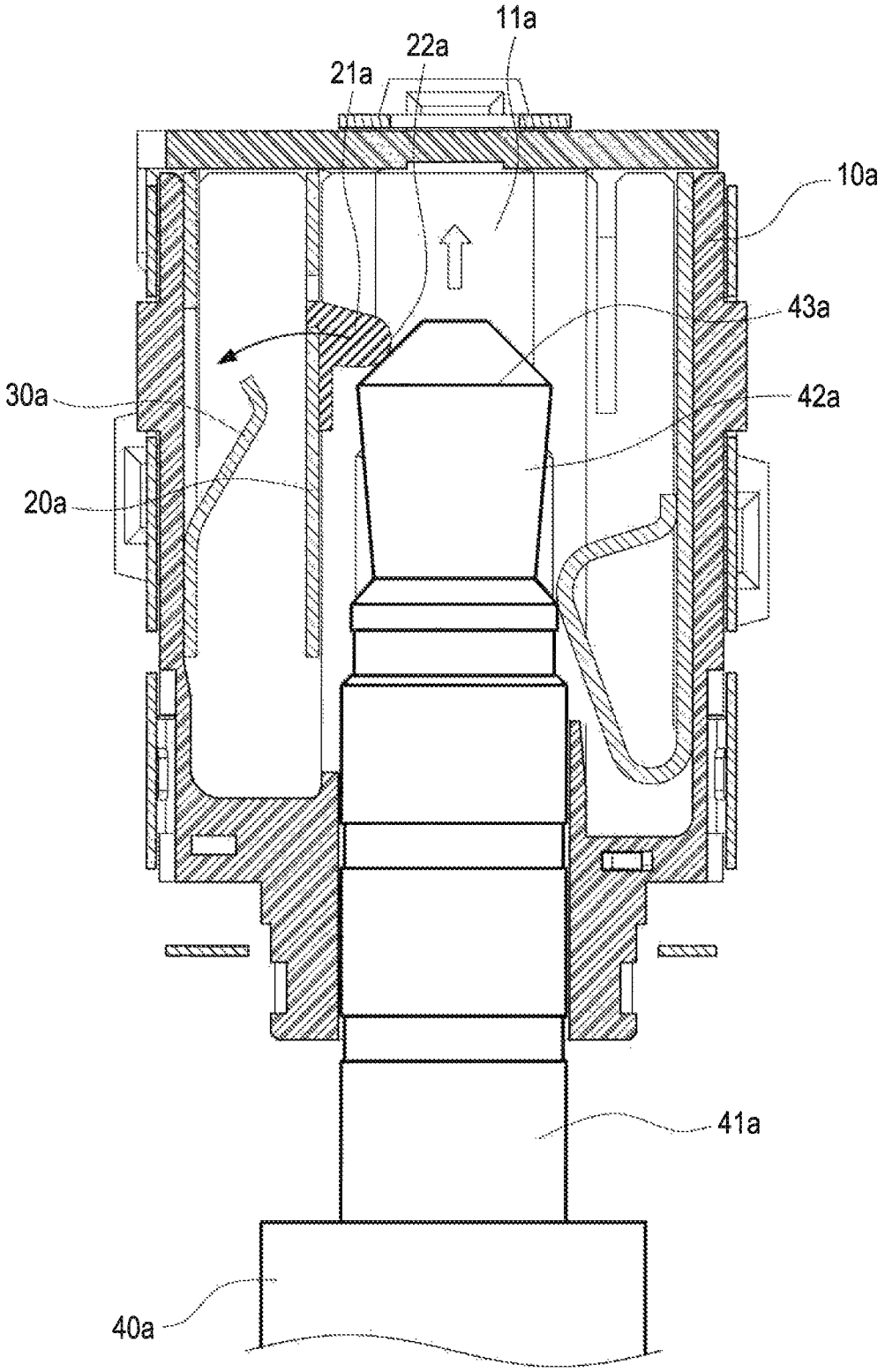
FIG. 1 is a schematically sectional structure view of an audio jack according to the related art.
Figure 2:
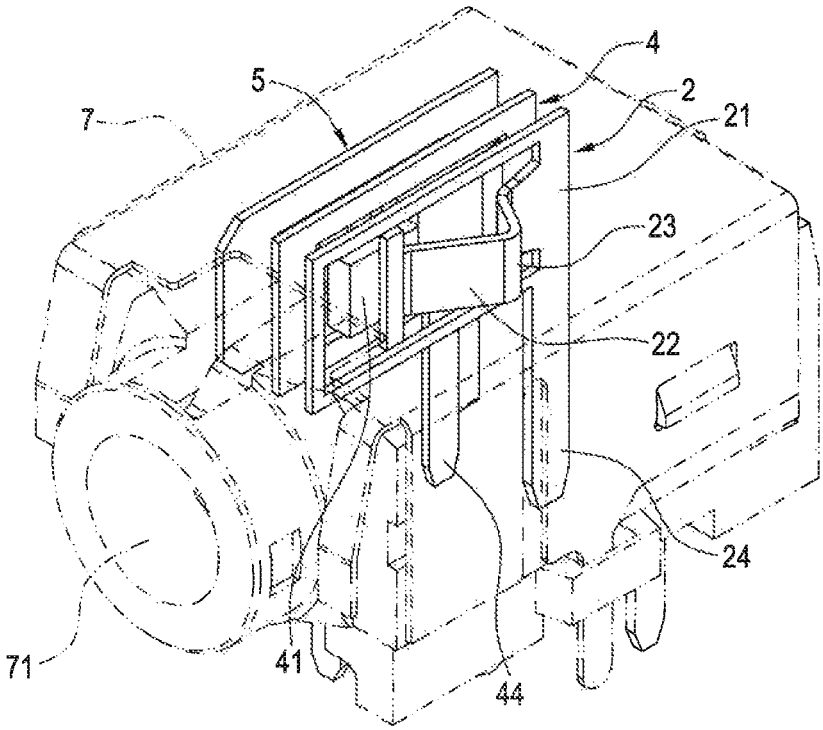
FIG. 2 is a schematically perspective view of an audio jack according to the present invention.
Figure 3:
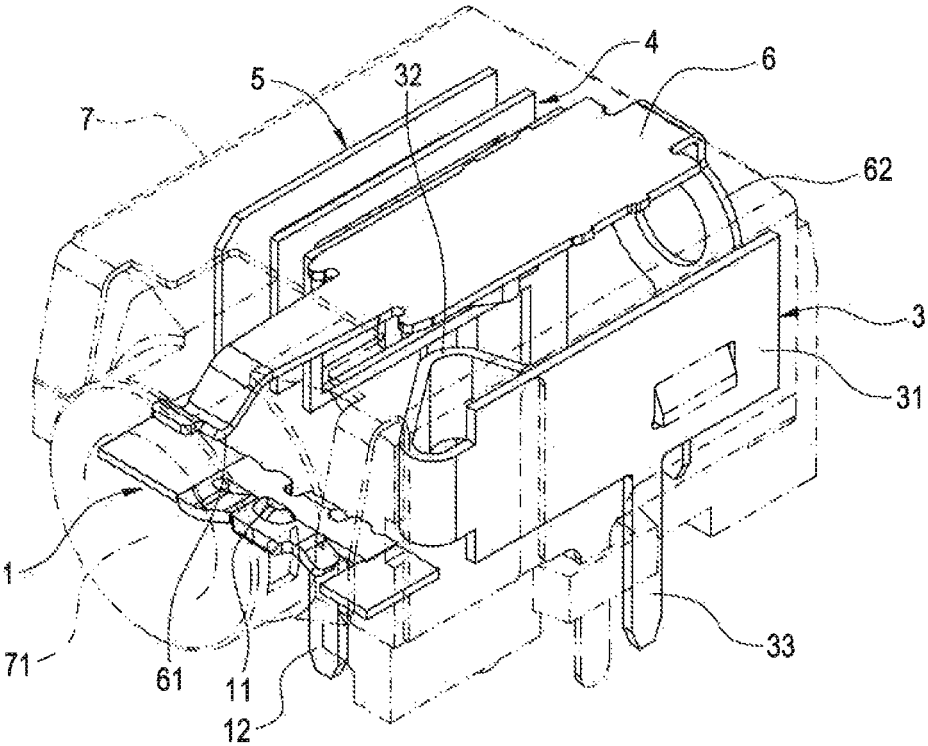
FIG. 3 is another schematically perspective view of the audio jack according to the present invention.
Figure 4:
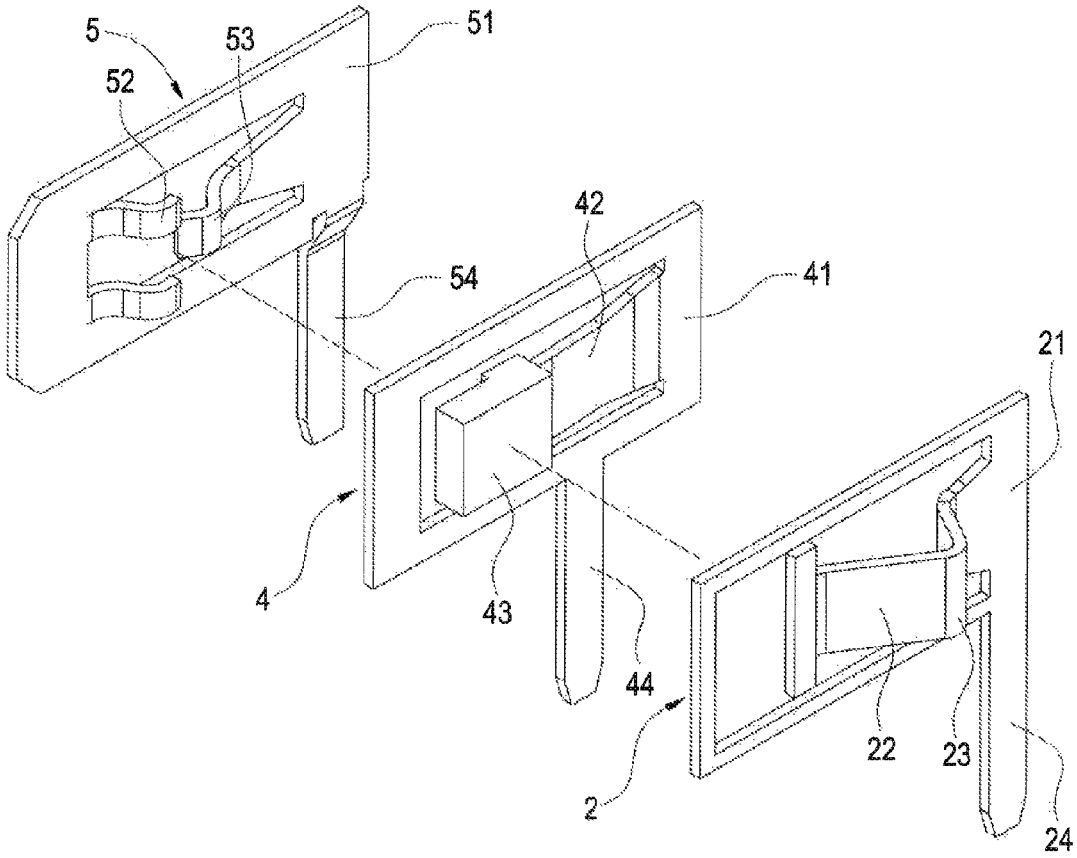
FIG. 4 is a schematically perspective view of a part of a connecting pin according to the present invention.

The technical contents and the detailed description of the present invention are illustrated with the accompanied drawings as follows.

Please refer to FIGS. 2-5, which are schematically perspective views of an audio jack, and a schematically perspective view and a schematically sectional top view of a part of a connecting pin according to the present invention, as illustrated, the audio jack of the present invention comprises a ground connecting pin 1, a first audio channel connecting pin 2, a second audio channel connecting pin 3, a start connecting pin 4, a detective connecting pin 5 and a microphone connecting pin 6. Each of the above-mentioned connecting pins is packaged in a base body 7 made of plastic materials and surroundingly disposed to an inserting hole 71 of the base body 7.

The ground connecting pin 1 is disposed inside the base body 7 and has a front connecting point 11 electrically contacting with a ground end of an inserting plug of an earphone (not shown) and a back connecting point 12 and electrically connected to an external circuit board (not shown). In this view, the ground connecting pin 1 is made of metal materials and is of plate shape or sheet shape.

The first audio channel connecting pin 2 is a left audio channel connecting pin or a right audio channel connecting pin. The first audio channel connecting pin 2 is disposed inside the base body 7, and has a plate body 21. An elastic sheet 22 of L-shape or V-shape extends from the plate body 21. The elastic sheet 22 has a bending portion 23. The bending portion 23 electrically contacts with a left audio channel end or a right audio channel end of the inserting plug of the earphone (not shown). Further, the plate body 21 has a contacting portion 24. The contacting portion 24 is electrically connected to the external circuit board (not shown). In this view, the first audio channel connecting pin 2 is made of metal materials and is of plate shape or sheet shape.

The second audio channel connecting pin 3 is a left audio channel connecting pin or a right audio channel connecting pin The second audio channel connecting pin 3 is disposed to the inside of the base body 7, and has a sheet portion 31. A contacting elastic sheet 32 of L-shape, C-shape or V-shape extends from the sheet portion 31. The contacting elastic sheet 32 electrically contacts with the right audio channel end or the left audio channel end of the inserting plug of the earphone (not shown). Further, the sheet portion 31 has a contacting point 33. The contacting point 33 is electrically connected to the external circuit board (not shown). In this view, the second audio channel connecting pin 3 is made of metal materials and is of plate shape or sheet shape.

The start connecting pin 4 is disposed inside the base body 7, corresponds to the first audio channel connecting pin 2 with each other, and has a flat plate body 41 corresponding to the first audio channel connecting pin 2 with each other. The flat plate body 41 has an acting portion 42. The acting portion 42 has an insulating portion 43 covering a part of the acting portion 42. An end of the start connecting pin 4 has an electrical connecting point 44. The electrical connecting point 44 is electrically connected to the external circuit board (not shown). After the elastic sheet 22 of the first audio channel connecting pin 2 is collided, the elastic sheet 22 collides the insulating portion 43 of the start connecting pin 4 for driving the acting portion 42 to act. In this view, the start connecting pin 4 is made of metal materials and is of plate shape or sheet shape.

The detective connecting pin 5 is disposed inside the base body 7, corresponds to the start connecting pin 4 with each other, and has a main body 51 of flat-plate shape. A first conducting portion 52 and a second conducting portion 53 of curved-arc shape corresponding to each other extend from the main body 51. Further, the main body 51 has a contacting end 54. The contacting end 54 is electrically connected to the external circuit board (not shown). When the start connecting pin 4 is collided to act, after the start connecting pin 4 contacts with the detective connecting pin 5, a telecommunication loop is formed, such that the external circuit board recognizes insertion of the inserting plug of the earphone. In this drawing, the detective connecting pin 5 is made of metal materials and is of plate shape or sheet shape.

The microphone connecting pin 6 is disposed inside the base body 7, and has a first contacting portion 61 of L-shape, C-shape or V-shape formed on an end thereof, the electrical contacting portion 61 electrically contacting with a microphone end of the inserting plug of the earphone (not shown), and a second contacting portion 62 formed on another end thereof, the second contacting portion 62 electrically connected to the external circuit board (not shown). In this drawing, the microphone connecting pin 6 is made of metal materials and is of plate shape or of sheet shape.

Figure 5:
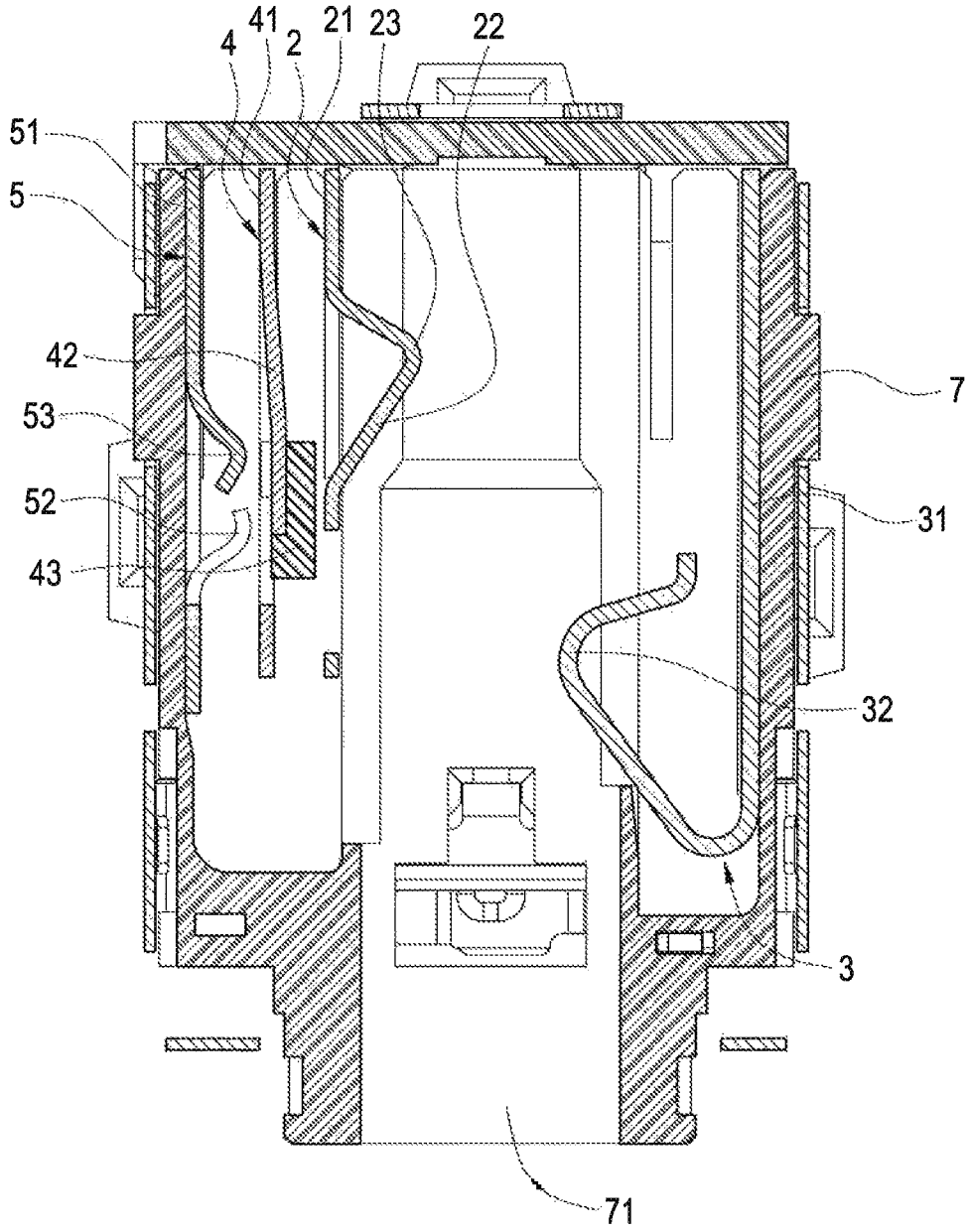
FIG. 5 is a schematically sectional top view of the audio jack according to the present invention.
Figure 6:
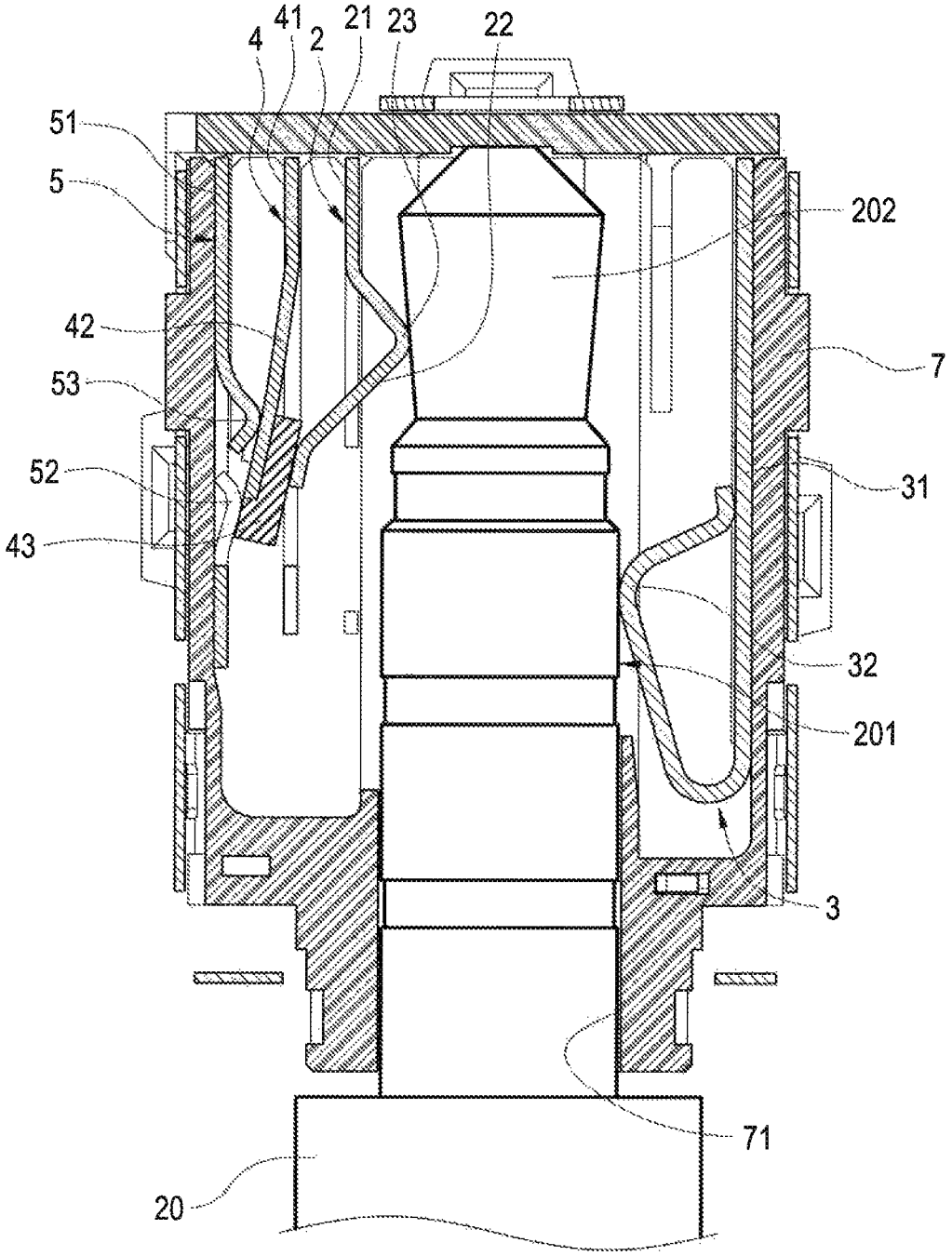
FIG. 6 is a schematic action view of insertion of an inserting plug of an earphone into the audio jack according to the present invention.
Figure 7:
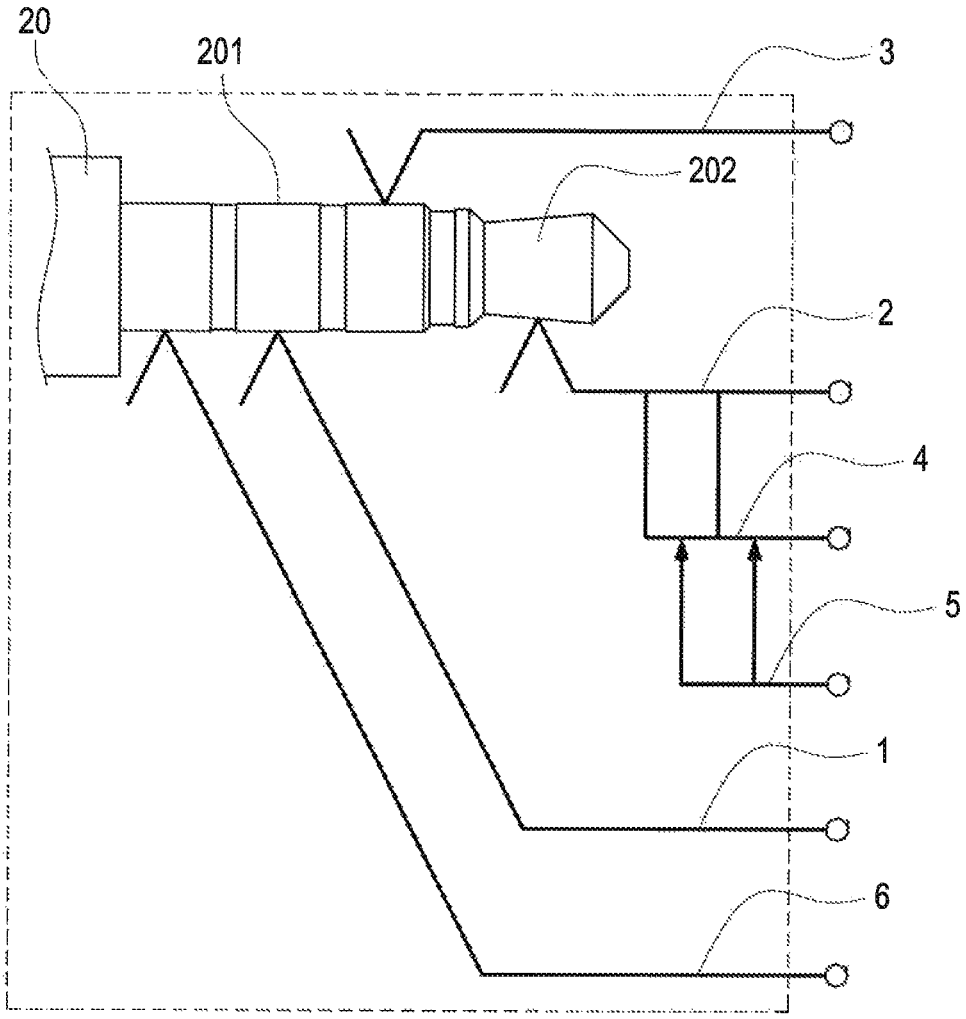
FIG. 7 is a schematic circuit view of the audio jack according to the present invention.
Figure 8:
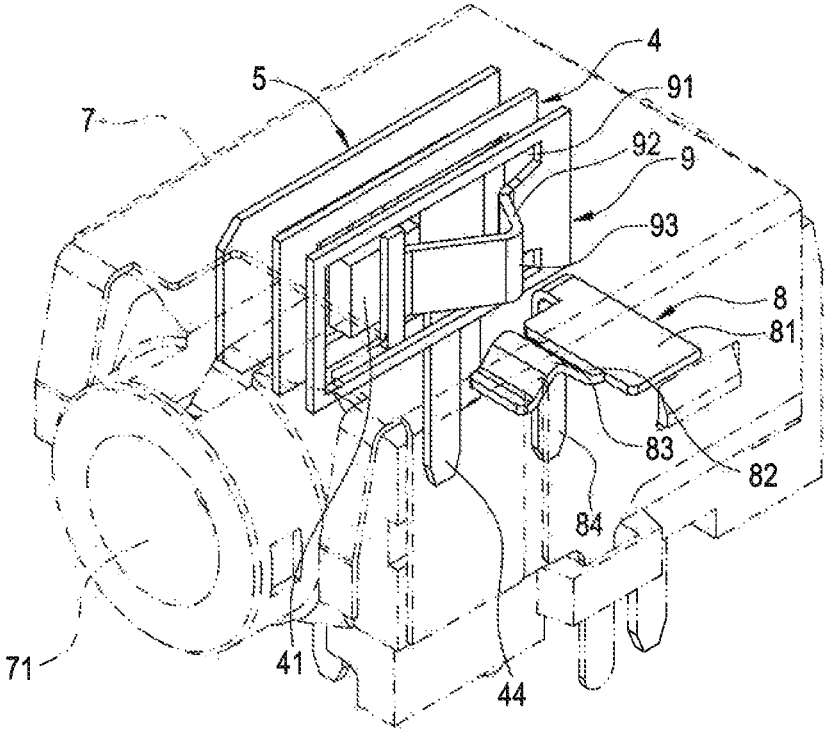
FIG. 8 is a schematically perspective view of the audio jack according to another embodiment of the present invention.
Figure 9:
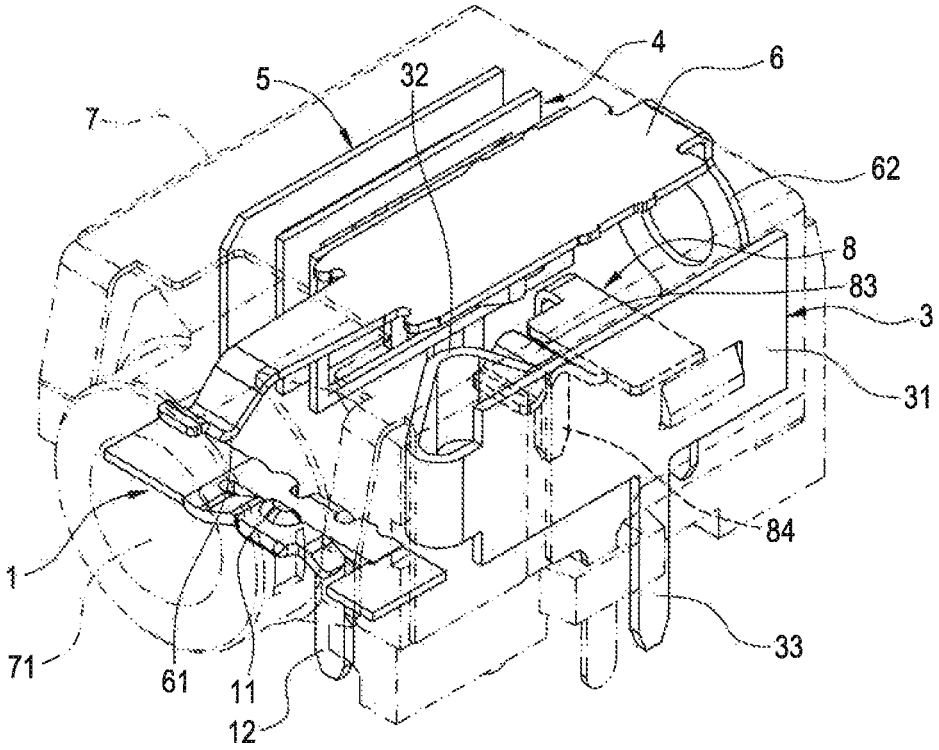
FIG. 9 is another schematically perspective view of the audio jack according to another embodiment of the present invention.
Figure 10:
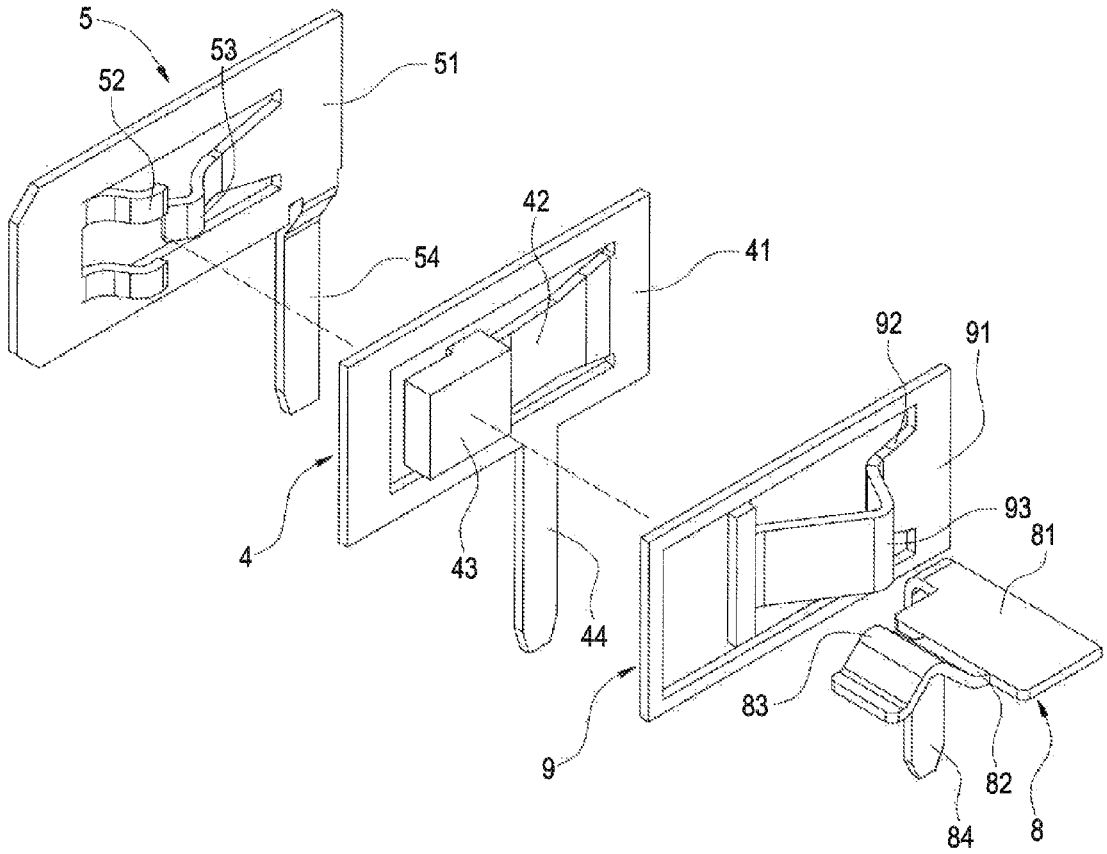
FIG. 10 is a schematically perspective view of the part of the connecting pin according to another embodiment of the present invention.
Figure 11:
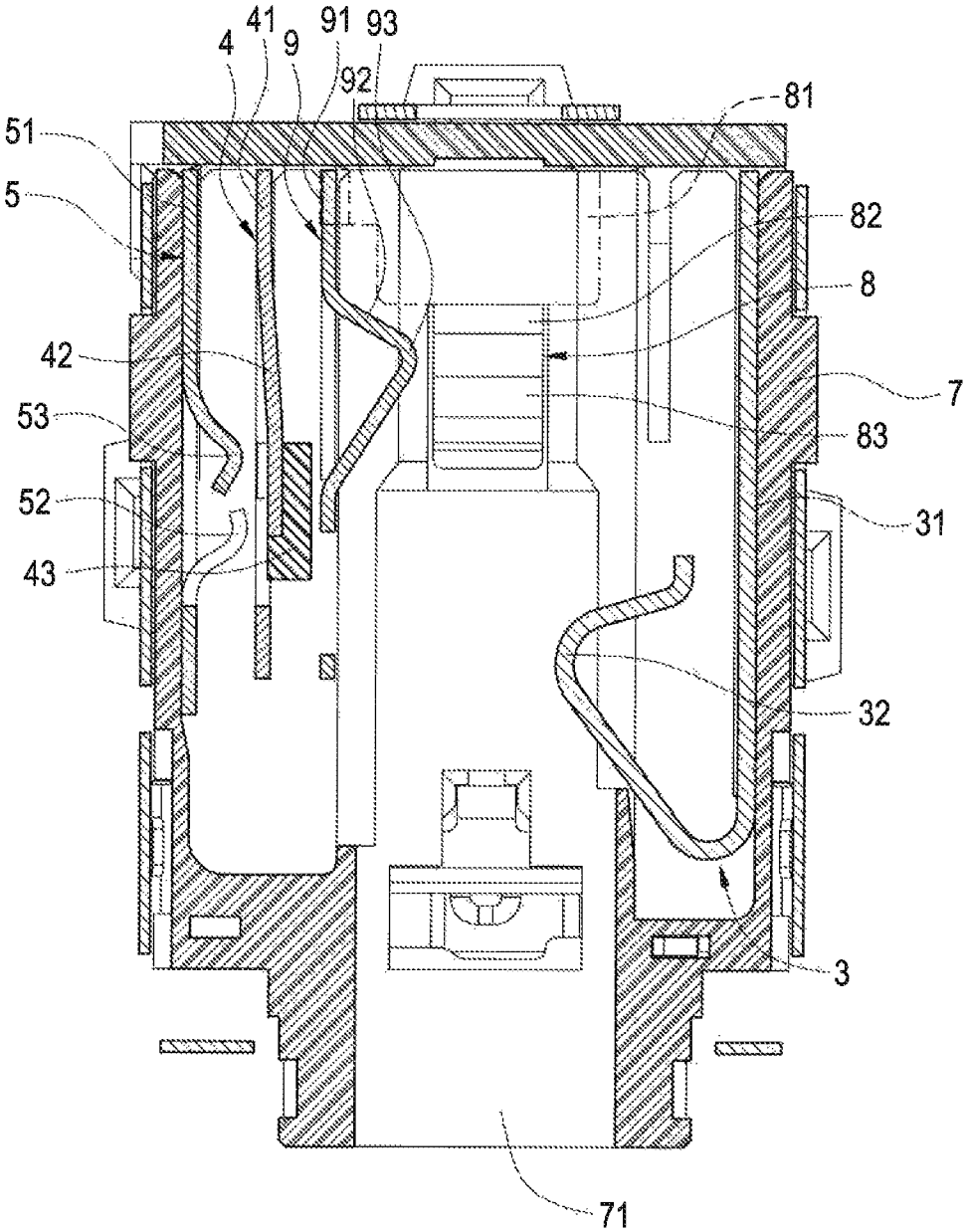
FIG. 11 is a schematically sectional top view of the audio jack according to another embodiment of the present invention.
Figure 12:
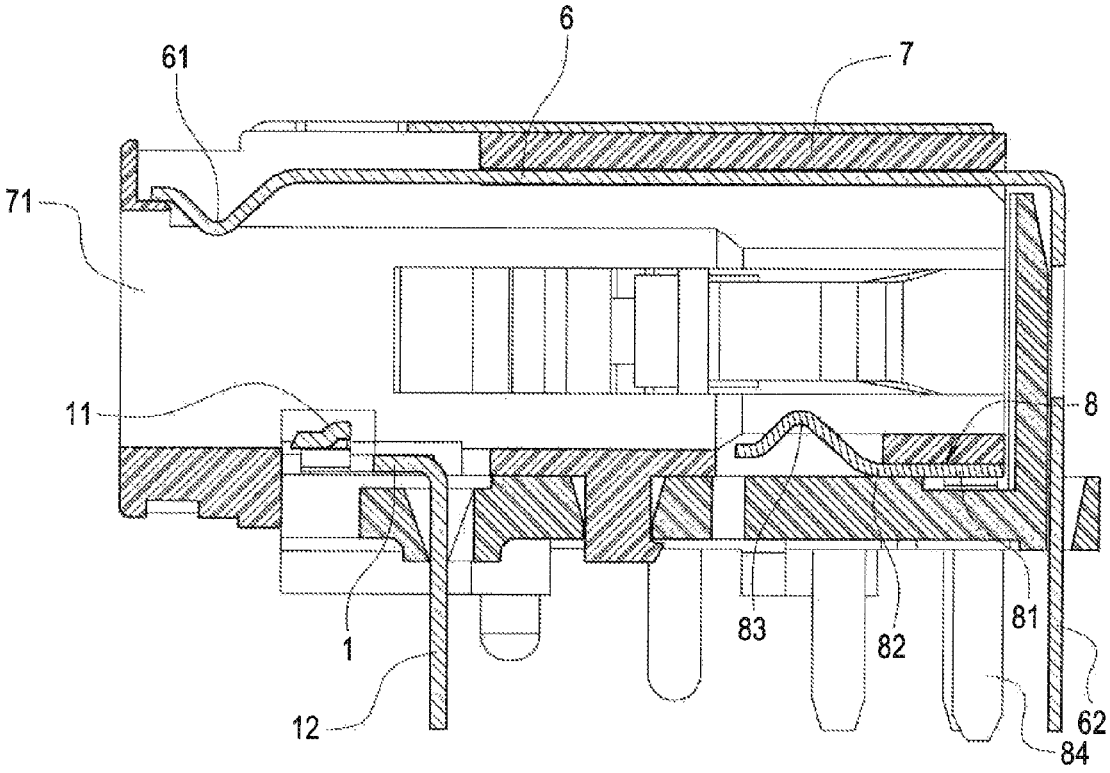
FIG. 12 is a schematically sectional side view of the audio jack according to another embodiment of the present invention.
Figure 13:
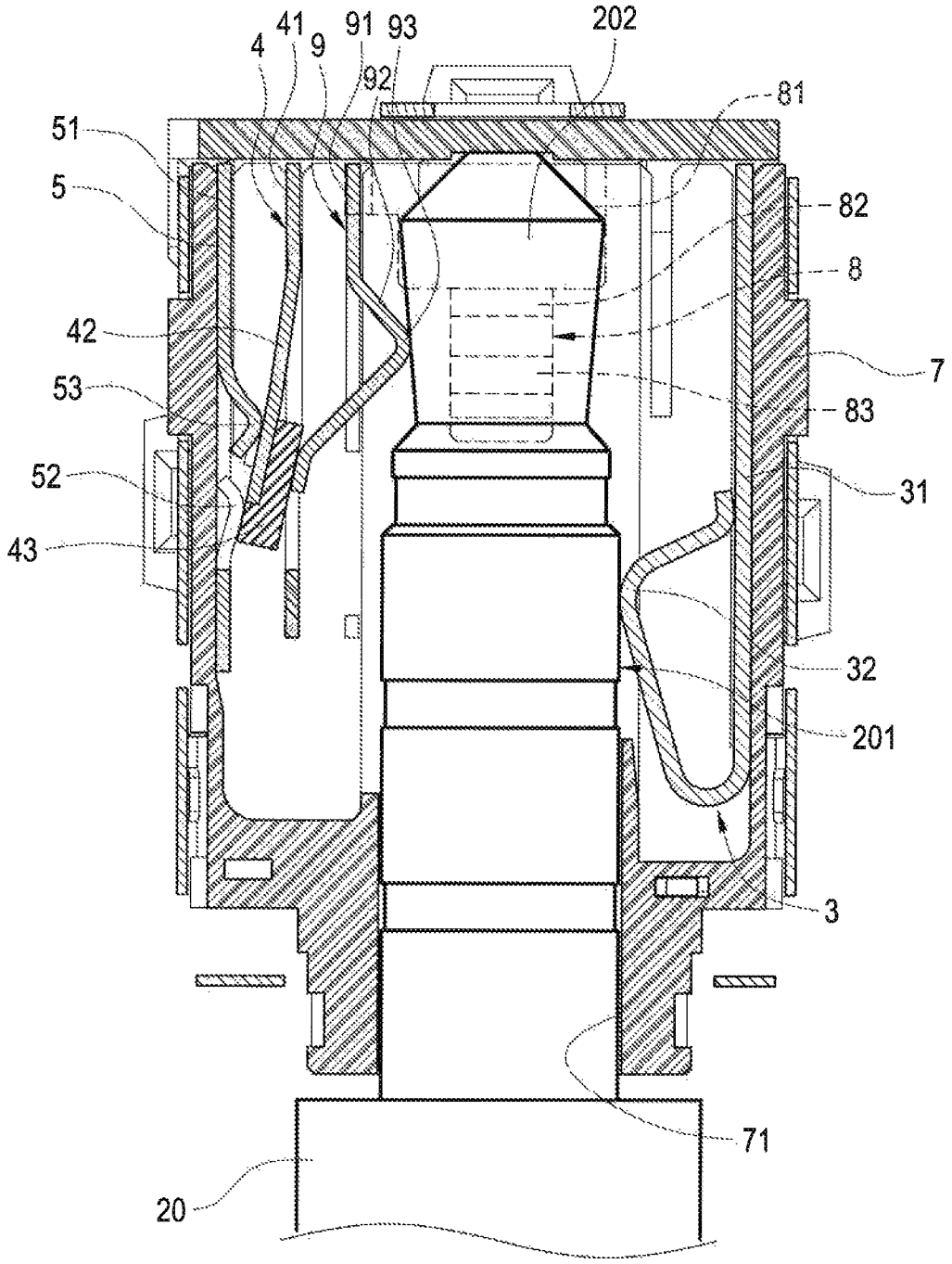
FIG. 13 is a schematic action view of insertion of the inserting plug of the earphone of the audio jack into an inside of the audio jack according to another embodiment of the present invention.
Figure 14:
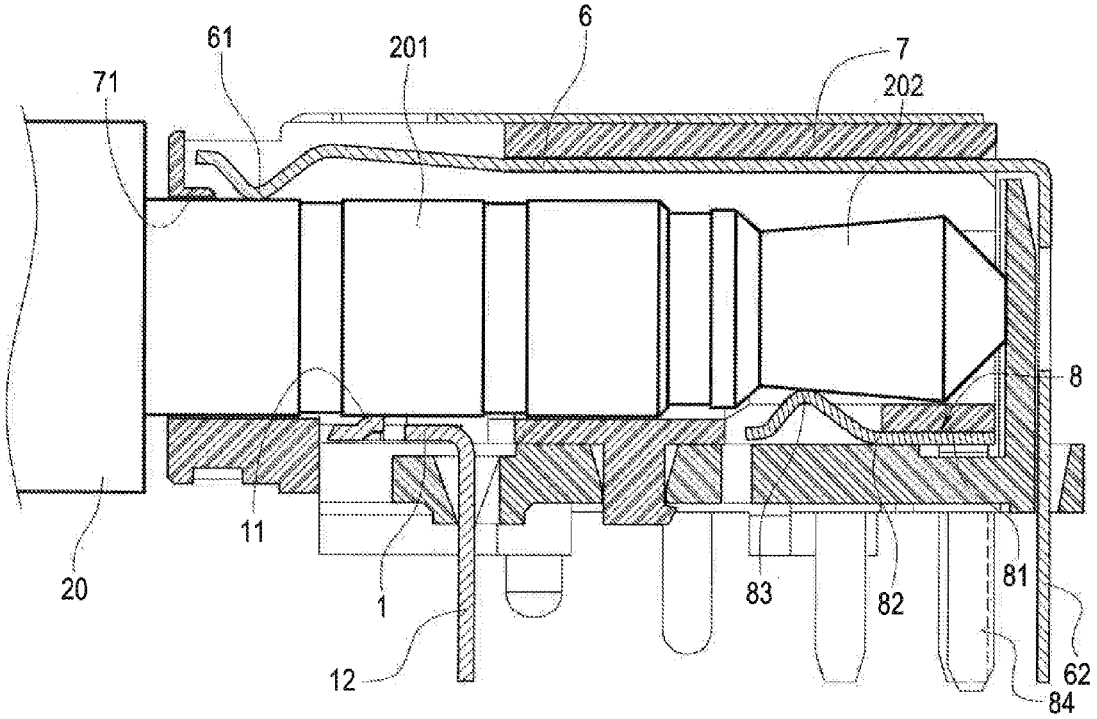
FIG. 14 is another schematic action view of insertion of the inserting plug of the earphone of the audio jack into the inside of the audio jack according to another embodiment of the present invention.
Figure 15:
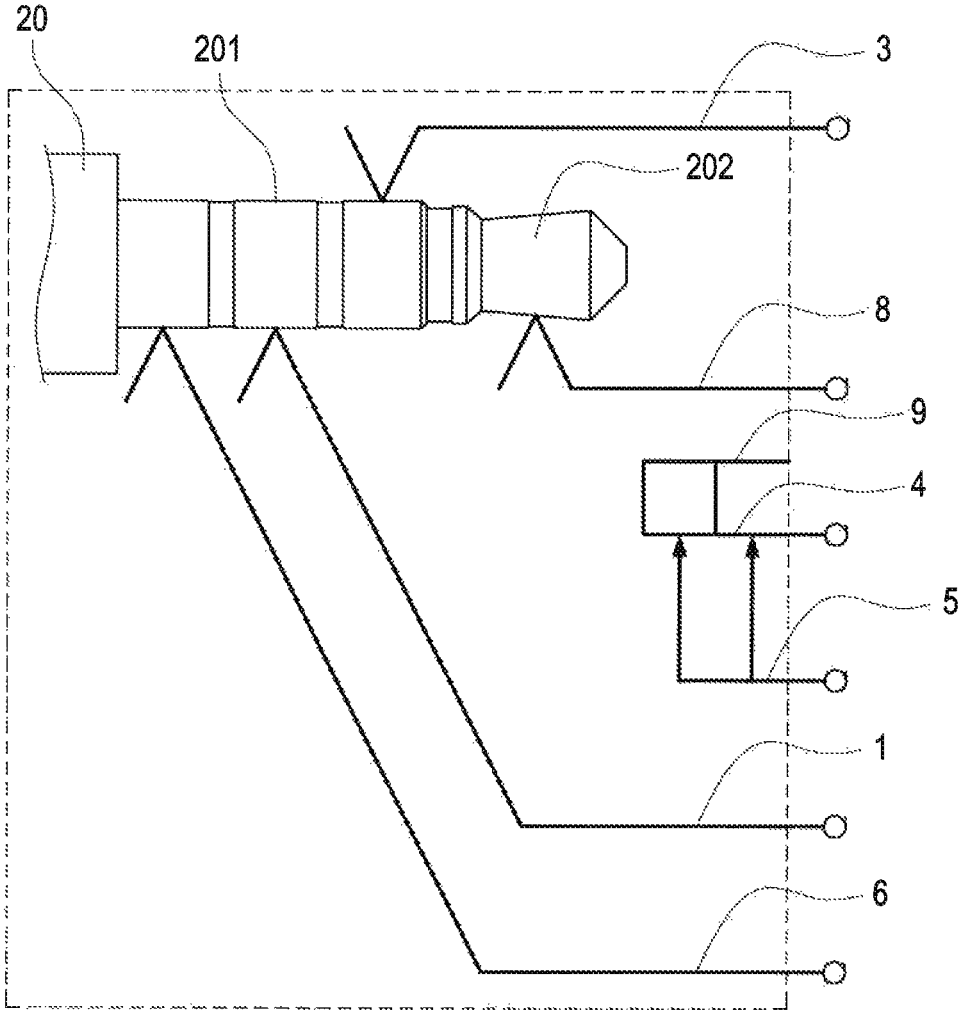
FIG. 15 is a schematic circuit view of the audio jack according to another embodiment of the present invention.

Please refer to FIGS. 5-7, which are a sectional top view of the audio jack, a schematic action view of insertion of the inserting plug of the earphone into the audio jack and a schematic circuit view of the audio jack according to the present invention, as illustrated, when an user listens to music or talks, and inserts a probing needle 201 of the inserting plug of the earphone into the inserting hole 71 of the base body 7, a head portion 202 with a water-drop shape front end of the probing needle 201 collides the bending portion 23 of the elastic sheet 22 of the first audio channel connecting pin 2, such that an end of the elastic sheet 22 collides the insulating portion 43 of the start connecting pin 4 to act for driving the acting portion 42 to contact and conduct with the first conducting portion 52 or the second conducting portion 53 of the detective connecting pin 5, and that the start connecting pin 4 and the detective connecting pin 5 form a signal conduction loop. Accordingly, the external circuit board (not shown) detects insertion of the probing needle 201 of the inserting plug 20, the circuit board transmits voice of a left right audio channel and a right audio channel to the first audio channel connecting pin 2 and the second audio channel connecting pin 3, and voice of a microphone is transmitted to the circuit board via the microphone connecting pin 6.

In the present invention, since the acting portion 42 is integrally formed on the start connecting pin 4 for decreased wear, the problem of the head portion 202 of the probing needle 201 of the inserting plug 20 of the earphone having an external diameter with a step mismatch of ø2.5-ø3.0 mm is solved, such that the start connecting pin 4 and the detective connecting pin 5 can stably contact with each other. At the same time, production can be much easier, and cost can be lowered.

Please refer to FIGS. 8-11, which are a schematically perspective view and another schematically perspective view of the audio jack, a schematically perspective view of the part of the connecting pin and a schematically sectional top view of the audio jack according to another embodiment of the present invention, as illustrated, the audio jack of the present invention comprises a ground connecting pin 1, a first audio channel connecting pin 8, a second audio channel connecting pin 3, a first start connecting pin 9, a second start connecting pin 4, a detective connecting pin 5 and a microphone connecting pin 6. Each of the above-mentioned connecting pins are packaged in a base body 7 made of plastic materials. In addition, in this embodiment, the disclosed technique is substantially the same as that of FIGS. 1-7, the difference is in the first audio channel connecting pin 8 and first start connecting pin 9.

The first audio channel connecting pin 8 is a left audio channel connecting pin or a right audio channel connecting pin. The first audio channel connecting pin 8 is disposed to an inside of the base body 7, and has a flat plate portion 81. An extending sheet 82 extends from the flat plate portion 81. The extending sheet 82 has a crooking portion 83. The crooking portion 83 electrically contacts with a left audio channel end or a right audio channel end of an inserting plug of an earphone (not shown). Further, an electrode portion 84 bends on a side of the flat plate portion 81. The electrode portion 84 is electrically connected to the external circuit board (not shown). In this view, the first audio channel connecting pin 8 is made of metal materials.

The first start connecting pin 9 is disposed inside the base body 7, vertically and correspondingly arranged to the first audio channel connecting pin 8, parallelly corresponds to the second start connecting pin 4, and has a frame body 91. An elastic sheet 92 of L-shape or V-shape extends from the frame body 91. The elastic sheet 92 has a bending portion 93. The bending portion 93 is collided by the inserting plug of the earphone to act so as to collide the insulating portion 43 of the second start connecting foot 4.

Please refer to FIGS. 12-15, which are a schematically sectional side view of the audio jack, a schematic action view and another schematic action view of insertion of the inserting plug of the earphone of the audio jack into of the audio jack and a schematic circuit view of the audio jack according to another embodiment of the present invention, as illustrated:

When an user intends to listen to music or talks, and inserts the probing needle 201 of the inserting plug 20 of the earphone into the inserting hole 71 of the base body 7, the head portion 202 with the water-drop shape front end of the probing needle 201 simultaneously collides the crooking portion 83 of the first audio channel connecting pin 8 and the bending portion 93 of the first start connecting pin 9, such that an end of the elastic sheet 92 collides the insulating portion 43 of the start connecting pin 4 to act for driving the acting portion 42 to contact and conduct with the first conducting portion 52 or the second conducting portion 53 of the detective connecting pin 5, and that the start connecting pin 4 and the detective connecting pin 5 form a signal conduction loop. Accordingly, the external circuit board (not shown) detects insertion of the probing needle 201 of the inserting plug 20, the circuit board transmits voice of a left right audio channel and a right audio channel to the first audio channel connecting pin 8 and the second audio channel connecting pin 3, and voice of a microphone is transmitted to the circuit board via the microphone connecting pin 6.

Although the present invention has been described with reference to the foregoing preferred embodiment, it will be understood that the invention is not limited to the details thereof. Thus, all such variations and equivalent modifications in view of the teachings of the present invention are embraced within the scope of the invention as defined in the appended claims.

What is claimed is:

1. An audio jack for an inserting plug of an earphone, comprising:

a base body having an inserting hole;

a first audio channel connecting pin disposed inside the base body and surroundingly disposed to the inserting hole, the first audio channel connecting pin having a plate body, an elastic sheet extending from the plate body, the elastic sheet having a bending portion;

a start connecting pin disposed inside the base body and corresponding to the first audio channel connecting pin, the start connecting pin having a flat plate body corresponding to the first audio channel connecting pin, the flat plate body having an acting portion, the acting portion having an insulating portion;

a detective connecting pin disposed inside the base body and corresponding to the start connecting pin, the detective connecting pin having a main body, the main body having a first conducting portion and a second conducting portion corresponding to each other and extending from a side of the main body;

wherein, after the inserting plug of the earphone is inserted for colliding the bending portion of the elastic sheet, the elastic sheet collides the insulating portion, such that the acting portion is driven for contacting and conducting with the first conducting portion or the second conducting portion, so as to send a detection signal.

2. The audio jack according to claim 1, wherein the first audio channel connecting pin is a left audio channel connecting pin or a right audio channel connecting pin, the elastic sheet of the first audio channel connecting pin is of L-shape or V-shape, the plate body of the first audio channel connecting pin has a contacting portion, and the contacting portion is electrically connected to an external circuit board.

3. The audio jack according to claim 2, wherein an end of the start connecting pin has an electrical connecting point, and the electrical connecting point is electrically connected to the external circuit board.

4. The audio jack according to claim 3, wherein the main body of the detective connecting pin is of flat-plate shape, the main body has a contacting end, the contacting end is electrically connected to the external circuit board, and the first conducting portion and the second conducting portion of the detective connecting pin are of curved-arc shape.

5. The audio jack according to claim 4, further including a ground connecting pin disposed inside the base body and surroundingly disposed to the inserting hole, the ground connecting pin having a front connecting point and a back connecting point electrically connected to the external circuit board.

6. The audio jack according to claim 5, further including a second audio channel connecting pin being a left audio channel connecting pin or a right audio channel connecting pin, the second audio channel connecting pin disposed inside the base body and surroundingly disposed to the inserting hole, the second audio channel connecting pin having a sheet portion, a contacting elastic sheet of L-shape, C-shape or V-shape extending from an end of the sheet portion, the sheet portion having a contacting point, the contacting point electrically connected to the external circuit board.

7. The audio jack according to claim 6, further including a microphone connecting pin disposed to the inside of the base body and surroundingly disposed to the inserting hole, an end of the microphone connecting pin having a first contacting portion of L-shape, C-shape or V-shape, another end of the microphone connecting pin having a second contacting portion, the second contacting portion electrically connected to the external circuit board.

8. An audio jack for an inserting plug of an earphone, comprising:

a base body having an inserting hole;

a first audio channel connecting pin disposed inside the base body and surroundingly disposed to the inserting hole, the first audio channel connecting pin having a flat plate portion, an extending sheet extending from the flat plate portion, the extending sheet having a crooking portion, an electrode portion bending from a side of the flat plate portion;

a first start connecting pin disposed to the inside of the base body and surroundingly disposed to the inserting hole, the first start connecting pin having a frame body, an elastic sheet extending from the frame body, the elastic sheet having a bending portion;

a second start connecting pin disposed inside the base body and corresponding to the first start connecting pin, the second start connecting pin having a flat plate body corresponding to the first start connecting pin, the flat plate body having an acting portion, the acting portion having an insulating portion;

a detective connecting pin disposed inside the base body and corresponding to the start connecting pins, the detective connecting pin having a main body, a first conducting portion and a second conducting portion corresponding to each other and extending from a side of the main body;

wherein, after the inserting plug of the earphone is inserted for simultaneously colliding the crooking portion of the first audio channel connecting pin and the bending portion of the first start connecting pin, an end of the elastic sheet collides the insulating portion of the second start connecting pin, such that the acting portion is driven for contacting and conducting with the first conducting portion or the second conducting portion, so as to send a detection signal.

9. The audio jack according to claim 8, wherein the first audio channel connecting pin is a left audio channel connecting pin or a right audio channel connecting pin, and the electrode portion is electrically connected to an external circuit board.

10. The audio jack according to claim 9, wherein an end of the second start connecting pin has an electrical connecting point, and the electrical connecting point is electrically connected to the external circuit board.

11. The audio jack according to claim 10, wherein the main body of the detective connecting pin is of flat-plate shape, the main body has a contacting end, the contacting end is electrically connected to the external circuit board, and the first conducting portion and the second conducting portion of the detective connecting pin are of curved-arc shape.

12. The audio jack according to claim 11, further including a ground connecting pin disposed inside the base body and surroundingly disposed to the inserting hole, the ground connecting pin having a front connecting point and a back connecting point electrically connected to the external circuit board.

13. The audio jack according to claim 12, further including a second audio channel connecting pin being a left audio channel connecting pin or a right audio channel connecting pin, disposed inside the base body and surroundingly disposed to the inserting hole, the second audio channel connecting pin having a sheet portion, a contacting elastic sheet of L-shape, C-shape or V-shape extending from an end of the sheet portion, the sheet portion having a contacting point, the contacting point electrically connected to the external circuit board.

14. The audio jack according to claim 13, further including a microphone connecting pin disposed inside the base body and surroundingly disposed to the inserting hole, an end of the microphone connecting pin having a first contacting portion of L-shape, C-shape or V-shape, another end of the microphone connecting pin having a second contacting portion, the second contacting portion electrically connected to the external circuit board.

15. A sound effect output device, including:

an audio jack for insertion of an inserting plug of an earphone, comprising:

a base body having an inserting hole;

a first audio channel connecting pin disposed inside the base body and surroundingly disposed to the inserting hole, the first audio channel connecting pin having a flat plate portion, an extending sheet extending from the flat plate portion, the extending sheet having a crooking portion, an electrode portion bending from a side of the flat plate portion;

a first start connecting pin disposed inside the base body and surroundingly disposed to the inserting hole, the first start connecting pin having a frame body, an elastic sheet extending from the frame body, the elastic sheet having a bending portion;

a second start connecting pin disposed inside the base body and corresponding to the first start connecting pin, the second start connecting pin having a flat plate body corresponding to the first start connecting pin, the flat plate body having an acting portion, the acting portion having an insulating portion, an end of the second start connecting pin having an electrical connecting point;

a detective connecting pin disposed inside the base body and corresponding to the start connecting pins, the detective connecting pin having a main body, a first conducting portion and a second conducting portion corresponding to each other extending from a side of the main body;

wherein, after the inserting plug of the earphone is inserted for simultaneously colliding the crooking portion of the first audio channel connecting pin and the bending portion of the first start connecting pin, an end of the elastic sheet collides the insulating portion of the second start connecting pin, such that the acting portion is driven for contacting and conducting with the first conducting portion or the second conducting portion, so as to send a detection signal.

16. The sound effect output device according to claim 15, wherein the first audio channel connecting pin is a left audio channel connecting pin or a right audio channel connecting pin, and the electrode portion is electrically connected to an external circuit board.

17. The sound effect output device according to claim 16, wherein the main body of the detective connecting pin is of flat-plate shape, the main body has a contacting end, the contacting end is electrically connected to the external circuit board, and the first conducting portion and the second conducting portion of the detective connecting pin are of curved-arc shape.

18. The sound effect output device according to claim 17, further including a ground connecting pin disposed inside the base body and surroundingly disposed to the inserting hole, the ground connecting pin having a front connecting point and a back connecting point electrically connected to the external circuit board.

19. The sound effect output device according to claim 18, further including a second audio channel connecting pin being a left audio channel connecting pin or a right audio channel connecting pin, disposed inside the base body and surroundingly disposed to the inserting hole, the second audio channel connecting pin having a sheet portion, a contacting elastic sheet of L-shape, C-shape or V-shape extending from an end of the sheet portion, the sheet portion having a contacting point, the contacting point electrically connected to the external circuit board.

20. The sound effect output device according to claim 19, further including a microphone connecting pin disposed inside of the base body and surroundingly disposed to the inserting hole, an end of the microphone connecting pin having a first contacting portion of L-shape, C-shape or V-shape, another end of the microphone connecting pin having a second contacting portion, the second contacting portion electrically connected to the external circuit board.

* * * * *